US008293039B2

(12) United States Patent
Hatakeyama

(10) Patent No.: US 8,293,039 B2
(45) Date of Patent: Oct. 23, 2012

(54) METHOD OF MANUFACTURING COPPER-BASED ALLOY SHEET

(75) Inventor: Kouichi Hatakeyama, Iwata (JP)

(73) Assignee: Dowa Metaltech Co., Ltd., Tokyo (JP)

( * ) Notice: Subject to any disclaimer, the term of this patent is extended or adjusted under 35 U.S.C. 154(b) by 1090 days.

(21) Appl. No.: 12/230,498

(22) Filed: Aug. 29, 2008

(65) Prior Publication Data

US 2009/0014102 A1 Jan. 15, 2009

Related U.S. Application Data

(62) Division of application No. 11/169,760, filed on Jun. 30, 2005, now abandoned.

(30) Foreign Application Priority Data

Jul. 1, 2004 (JP) ..... 2004-195984

(51) Int. Cl.
*C22C 9/06* (2006.01)

(52) U.S. Cl. ..... 148/684; 148/433

(58) Field of Classification Search ..... 148/432–436, 148/684

See application file for complete search history.

(56) References Cited

U.S. PATENT DOCUMENTS 6,699,337 B2 3/2004 Hatakeyama

FOREIGN PATENT DOCUMENTS

| | | |
|---|---|---|
| JP | 2000-80428 | 3/2000 |
| JP | 2002-180165 | 6/2002 |

*Primary Examiner* — Sikyin Ip

(74) *Attorney, Agent, or Firm* — Clark & Brody

(57) ABSTRACT

A method of manufacturing a sheet of a copper-based alloy containing controlled amounts of Ni, Sn, P, optionally Zn and Fe, Co, Mg, Ti, Cr, Zr, and Al with the remainder being Cu and unavoidable impurities, comprising the steps of cold rolling followed by annealing at least one time of an ingot of the copper-based alloy, thereafter performing intermediate cold rolling, which is a cold rolling process before final cold rolling process, performing annealing with controlled temperature and time to obtain sheet with a grain size of 20 μm or less, performing final cold rolling at a percent reduction Z to meet the following Formula $0.8\times(100-10X-Y)<Z<100-10X-Y$, where Z is percent cold reduction, X is Sn content, and Y is the total content (wt.%) of all elements other than Sn and Cu, and performing low-temperature annealing at a temperature below the recrystallization temperature.

6 Claims, No Drawings

METHOD OF MANUFACTURING COPPER-BASED ALLOY SHEET

This is a divisional of U.S. application Ser. No. 11/169,760 filed Jun. 30, 2005, now abandoned.

BACKGROUND OF THE INVENTION

1. Field of the Invention

This invention relates to a copper-based alloy that has a superior balance of conductivity, tensile strength and bending workability and to a method of manufacturing same, and more specifically to a copper-based alloy for use in consumer products, for example, for forming blanks for narrow-pitch connectors for use in telecommunications, blanks for automotive harness connectors, blanks for semiconductor lead frames and blanks for compact switches and relays and the like and a method of manufacturing same.

2. Background Art

Against the background of recent developments in portable and mobile electronic equipment, where the pin thickness and pin width of connectors mounted in computers, mobile phones, digital video cameras and the like are typically 0.10-0.30 mm, there is a trend for these to become even thinner and narrower as the final product is made more compact. As a result of higher volumes of information being input/output through each of these pins at higher data rates, the Joule heat arising from the ON current causes the temperature of the contacts to increase, sometimes even exceeding the temperature tolerance of the insulation enclosing the contacts. Moreover, some of the pins are used for supplying power, so the material used for them must have a reduced conductor resistance, namely a high conductivity, and thus the development of copper alloys to replace low-conductivity brass and phosphor bronze has become an urgent task. In addition, both strength/springiness and flexibility are indispensable at the time of the press-molding of pins, but making the molding size narrower and thinner becomes more necessary from a different standpoint than that up until now.

On the other hand, in automotive electronics, in order to handle increases in the number of circuits and mounting densities accompanying increasingly electronic control systems, the connectors mounted in automotive electronics must be made lighter and space-saving by making the connectors more compact, so for example, the width of a box-shaped female connector has been reduced from 2.3 mm, which was the mainstream ten years ago, to 0.64 mm at present. Naturally, high conductivity is required in the same manner as for portable electronics. In addition, in order to maintain good connection properties after being molded into a box-shaped connector, even though the sheet thickness is roughly 0.25 mm or nearly unchanged from in the past, strict shape tolerances are required, forcing the use of states where the inside radius R is nearly 0 or states of bending nearly to tight contact, and thus the working conditions are more strict than in the past.

Accordingly, if one wishes to improve conductivity even while achieving both good strength/springiness and bending workability, this cannot be achieved with brass or phosphor bronze or other materials that are solid-solution strengthened by the addition of large amounts of additive elements. Precipitation strengthening of materials is one example of a method of increasing the conductivity while also obtaining high strength and high springiness, but if precipitation strengthening is used, deterioration of the ductility and bending workability of the material is ordinarily not negligible, and when it is attempted to avoid this, the control of the amount of elements added and the working and heat treatment processes required to control the size and distribution of precipitates becomes complex and as a result the manufacturing costs become higher (as in patent document JP2000-80428A, for example). As one method still remaining for solid-solution strengthened materials, measures can be taken to suppress the amount of solid-soluble elements added that lead to decreased conductivity, and to modify the machining and heat-treatment processes, but reducing the solid-solution strengthening elements leads to reduced strength so one must rely on that much more on work hardening, so decreased ductility and formability are unavoidable. At any rate, there has been a need to establish methods of evaluation from unconventional standpoints and adopt measures that extend the field of view to standpoints based on studies of texture, but no dramatic improvements have been achieved.

As a result of extensive studies performed in order to solve the problems of the background art described above, the material used for narrow-pitch connectors and automotive box connectors, which are blanked to the desired shape by means of high-speed press-molding using dies, is forced to assume the state where the inside radius R of the box portion is nearly 0 or the state of bending nearly to tight contact as the terminals tend to become thinner and narrower, or more specifically the spring portion becomes 0.10-0.25 mm thick and 0.10-0.30 mm wide, and so how to achieve superior bending workability while maintaining high strength came up as an important problem to be solved from the standpoint of properties. Regarding bending workability in particular, the state of stress on the convex surface of a bend at the time of bending varies depending on the width/thickness ratio W/t (the ratio of the test piece width W to the sheet thickness t) from tension in a single axis to surface-strain tension, so it is mandatory to improve the bending workability in consideration of the surface-strain tension accompanying the deterioration of bending workability.

SUMMARY OF THE INVENTION

An object of the present invention is therefore to control the crystal orientation of the material and thus provide a copper-based alloy that has a superior balance of conductivity, tensile strength and bending workability. and a method of manufacturing same.

The present invention provides a copper-based alloy with improved bending workability and a method of manufacturing same by taking copper-based alloys and performing x-ray diffraction focusing primarily on the ND plane (the surface of sheet material; referred to in the present invention as the ND plane), and controlling the strength in specific directions among the crystal orientations thus obtained. Note that the x-ray diffraction intensity referred to here indicates the integrated intensity in a crystal orientation of the material as measured by the x-ray diffraction method, for example.

Namely, the present invention provides:

in its first aspect, a copper-based alloy containing Ni, Sn, P and also at least one or more elements selected from a group consisting of Zn, Si, Fe, Co, Mg, Ti, Cr, Zr and Al in a total amount of 0.01-30 wt. % (percent by weight; same hereinafter) with the remainder being Cu and unavoidable impurities, where the x-ray diffraction intensity ratio of the surface $S_{ND}$ is such that $0.05 \leqq S_{ND} \leqq 0.15$ [provided that $S_{ND}=I\{200\} \div [I\{220\}+I\{300\}]$, where I{200} is the x-ray diffraction intensity of the {100} plane, I{111} is the x-ray diffraction intensity of the {111} plane, I{220} is the x-ray diffraction intensity of the {110} plane, and I{311} is the x-ray diffraction intensity of the {311} plane; the same applies hereinafter];

in its second aspect, a copper-based alloy containing Ni: 0.01-4.0 wt. %, Sn: 0.01-10 wt. % and P: 0.01-0.20 wt. % with the remainder being Cu and unavoidable impurities, where the x-ray diffraction intensity ratio of the surface $S_{ND}$ is such that $0.05 \leqq S_{ND} \leqq 0.15$;

in its third aspect, a copper-based alloy containing Ni: 0.014.0 wt. %, Sn: 0.01-10 wt. % and P: 0.01-0.20 wt. % and also at least one or more elements selected from a group consisting of Zn, Si, Fe, Co, Mg, Ti, Cr, Zr and Al in a total amount of 0.01-30 wt. % with the remainder being Cu and unavoidable impurities, where the x-ray diffraction intensity ratio of the surface $S_{ND}$ is such that $0.05 \leqq S_{ND} \leqq 0.15$;

in its fourth aspect, a method of manufacturing a copper-based alloy according to any of the first through third aspects, comprising the steps of: taking an ingot of a copper-based alloy having the indicated elemental composition, performing a combination process of cold rolling followed by annealing at least one time and then performing intermediate rolling which is a rolling process prior to a final cold rolling process, thereby making the x-ray diffraction intensity ratio of the sheet surface $S_{ND}$ such that $0.05 \leqq S_{ND} \leqq 0.15$, and thereafter performing annealing to obtain sheet with a grain size of 20 μm or less, and then performing the final cold rolling and low-temperature annealing at a temperature below the recrystallization temperature;

in its fifth aspect, a method of manufacturing a copper-based alloy according to any of the first through third aspects, comprising the steps of: taking an ingot of a copper-based alloy having the indicated elemental composition, performing a combination process of cold rolling followed by annealing at least one time and then performing cold rolling at a percent reduction Z that satisfies the following Formula (1):

$$Z<100-10X-Y \quad (1)$$

[where Z is the percent cold reduction (%), X is the Sn content (wt. %) among the various elements, and Y is the total content (wt. %) of all elements other than Sn and Cu; the same applies hereinafter] followed by low-temperature annealing performed at a temperature below the recrystallization temperature [here, Formula (1) is preferably replaced by the following Formula (2):

$$0.8(100-10X-Y)<Z<100-10X-Y \quad (2)$$]; and in its sixth aspect, a method according to the fourth or fifth aspect wherein, prior to performing the combination process, at least one process selected in advance from among homogenization annealing and hot rolling is performed on the ingot.

The present invention provides a copper-based alloy that has a superior balance of conductivity, tensile strength, 0.2% yield strength, springiness, hardness and bendability and is suitable for use in connectors, switches, relays and the like, and thus satisfies the demand for material that can be made into thinner sheet and finer wire in response to recent high-density mounting in consumer electronics, telecommunications equipment and automotive components. Particularly, the present invention is able to improve remarkably the bending workability of high strength/high springiness copper based alloy.

DESCRIPTION OF THE PREFERRED EMBODIMENT

The present invention will now be described in detail.

The present invention achieves improved bending workability of copper-based alloys by, with particular attention to the material surface, performing x-ray diffraction and controlling the strength in specific directions among the orientations thus obtained.

First, at the time of bending, one observes surface roughness in the surface of the bend in the material, in the form of wrinkles appearing parallel to the axis of bending, where the convex portions of the wrinkles maintain a smooth state that is near that of the initial surface, while the concave portions expose a new surface. While it is preferable for articles molded by bending to have no wrinkles, thin sheets of copper alloy used for the connectors and such described above are required to have superior bending workability and from the standpoint of reliability, it is essential not only that no cracks occur in bends but also that the surface roughness patterns are finely dispersed. Not only do large wrinkle-shaped areas of surface roughness patterns appear to be cracks but also they could easily become the starting points for cracks when the connectors are attached or detached and when subjected to impact in use To increase the bending workability, the material must have good uniform elongation, namely a large n value, but thin sheets of tempered copper alloy for use in connectors are required to have high strength and high springiness at the time of terminal formation and mounting, and as a result the uniform elongation is small or roughly 1/10 of that of fully annealed material, so this effect cannot be expected. Accordingly, the only method left in order to improve bending workability is to disperse the wrinkle-shaped surface roughness patterns as finely as possible. When the surface is observed upon varying the amount of bending deformation, as the precursor stage to wrinkles, large numbers of fine indentations and step-like patterns occur at intervals generally on the order of the grain size. In other words, the grain boundaries take the role of material defects that become opportunities for constriction or necking. With increased amounts of deformation, portions of them become linked in the direction of the bending axis while elongating into wrinkles that are roughly parallel to the bending axis. When the period and amplitude of these wrinkles are observed, the width of the convex portions of the wrinkles is equivalent to a plurality of grains, so how readily they grow is thought to depend on the large number of microscopic indentations and steps that is present.

Cu-based polycrystalline materials with the FCC (face-centered cubic) structure have a combination of slip planes {111} and slip directions <110> (where { } indicates all equivalent planes, and < > indicates all equivalent directions (orientations)), or namely they have twelve {111}<110> slip systems, with one or more slip systems becoming active at the time of deformation.

Now, taking the surface of the sheet material to be the ND plane, attention is focused on four main types of planes, namely the {110} planes, {111} planes, {311} planes and the {100} planes. At the time of bending deformation, eight slip systems out of the twelve slip systems can be active, and the {100} plane that has the best symmetry of slip systems has the greatest effect on bending deformation. The {110} plane, {111} plane, {311} plane and other orientations tend to be where strain occurs more readily in the width direction than the thickness direction, so in polycrystalline materials they are greatly affected by adjacent grain orientations. On the other hand, the {100} plane is the cubic orientation {100}<100>, and this group of orientations is well known as a component that decreases the r value which is the plastic strain ratio, thus, it is easy to make the strain in the thickness direction. Specifically, at the time of bending deformation, the critical shear stress is equal in those slip systems that are active under conditions in which the stress is acting from tension in a single axis to surface-strain tension in each individually oriented grain, and moreover thickness stress readily occurs.

Accordingly, whether under single-axis tension conditions or surface-strain tension conditions, in either the LD (Longitudinal Direction: the direction parallel to the direction of rolling of the material), or the TD (Transversal Direction: the direction perpendicular to the direction of rolling of the material), there is thought to be an orientation in which a large strain is applied in the thickness direction, and there is a high probability of this becoming a starting point for an indentation during bending deformation, so suppressing the generation of grains having this orientation or dispersing them finely, or even if generation in this orientation is unavoidable, dispersing them uniformly at as small as possible of interval is thought to lead to improved bending workability.

Here, in the case of metals having the FCC (face-centered cubic) structure such as copper-based alloys, in x-ray diffraction, the x-ray diffraction intensities (or simply the diffraction intensities) of the {110} plane, {111} plane, {311} plane and {100} plane are represented by I{220}, I{111}, I{311} and I{200}, respectively.

Considering the above, as a result of extensive research in order to solve the problems of the background art, the diffraction intensity I{220} of the {110} plane, the diffraction intensity I{111} of the {111} plane, the diffraction intensity I{311} of the {311} plane and the diffraction intensity I{200} of the {100} plane were measured and improvement of the bending workability was achieved by introducing the parameter $S_{ND}$ defined as:

$$S_{ND}=I\{200\}+I\{111\}+I\{220\}+I\{311\}]$$

and controlling texture using this as an index. Namely, the shape of the surface of bends was good when $0.05 \leqq S_{ND} \leqq 0.15$.

On the other hand, when $S_{ND}<0.05$, the orientation plane density of the {110} plane for a representative becomes too high, and because these grains develop to form a group, this leads to localization of surface wrinkles during bending deformation and causes cracks on the surface. When $S_{ND}>0.15$, coarse grains with an orientation in the {100} plane have a spotty distribution, leading to localization of surface wrinkles during bending deformation and as a result wide wrinkles occur and moreover, the tensile strength does not reach 500 N/mm$^2$, so it is not suited to the molding and mounting of small pins. In addition, if one emphasizes the bending deformation characteristics, then it is preferable that $0.1 \leqq S_{ND} \leqq 0.15$.

Next, the range of constituents in the composition of the copper-based alloy according to the present invention is defined to be: Ni, Sn, P and also at least one or more elements selected from a group consisting of Zn, Si, Fe, Co, Mg, Ti, Cr, Zr and Al in a total amount of 0.01-30 wt. % with the remainder being Cu and unavoidable impurities. This composition is adopted because it maintains the balance among conductivity, tensile strength and 0.2% yield strength of the material and further increases the bending workability.

If the total amount of the Ni, Sn, P and also at least one or more elements selected from a group consisting of Zn, Si, Fe, Co, Mg, Ti, Cr, Zr and Al is less than 0.01 wt. %, while the conductivity increases, satisfactory tensile strength, 0.2% proof tress and other properties are difficult to obtain. In addition, while the tensile strength and 0.2% proof tress can be increased by raising the percent reduction to 98%, the bending workability deteriorates greatly. On the other hand, if the total amount of the Ni, Sn, P and also at least one or more elements selected from a group consisting of Zn, Si, Fe, Co, Mg, Ti, Cr, Zr and Al exceeds 30 wt. %, although the tensile strength and 0.2% yield strength can be increased, the conductivity is lowered and the bending workability also deteriorates.

Accordingly, the range of constituents in the composition of the copper-based alloy according to the present invention is defined to be a copper-based alloy containing: Ni, Sn, P and also at least one or more elements selected from a group consisting of Zn, Si, Fe, Co, Mg, Ti, Cr, Zr and Al in a total amount of 0.01-30 wt. % with the remainder being Cu and unavoidable impurities.

In addition, if the range of constituents in the composition is defined not as above but rather as containing Ni: 0.014.0 wt. %, Sn: 0.01-10 wt. % and P: 0.01-0.20 wt. % and also at least one or more elements selected from a group consisting of Zn, Si, Fe, Co, Mg, Ti, Cr, Zr and Al in a total amount of 0.01-30 wt. % with the remainder being Cu and unavoidable impurities, then among the above reasons, the grounds for and effect of the limitations on constituent elements and their content and such still apply if "Ni, Sn, P and also at least one or more elements selected from a group consisting of Zn, Si, Fe, Co, Mg, Ti, Cr, Zr and Al" is read as "at least one or more elements selected from a group consisting of Zn, Si, Fe, Co, Mg, Ti, Cr, Zr and Al."

In addition to the elements listed above as defined by the present invention, if at least one element selected from a group of elements consisting of, for example, Ag, Au, Bi, In, Mn, La, Pb, Pd, Sb, Se, Te and Y is present in a total amount of 2 wt. % or less, and contained as an additional element as defined by the present invention, then it may take a role in increasing the bending workability and will not impede the meritorious effects obtained.

An explanation will now be given regarding the main added elements as defined according to the present invention.

(1) Sn

Sn is a mandatory element for achieving both bending workability and strength and elasticity.

When Sn is in solid solution within a Cu matrix, it can greatly reduce the degree of concentration of the {100} planes that affects bending workability, and moreover it increases the degree of concentration of the { 110} planes and {311} planes in combination with working and heat treatment, and furthermore it can make the grains having {100} planes fine and uniformly distributed, and as a result the bending workability can be increased. In addition, it can increase the strength and elasticity at the same time. However, if the Sn content is less than 0.01 wt. %, then these meritorious effects are not sufficiently obtained but on the other hand if the Sn content exceeds 10 wt. %, then the drop in electrical conductivity becomes marked and this can have deleterious effects on the ease of casting and hot workability. In addition, Sn is expensive, so this would be disadvantageous from an economic standpoint. Accordingly, the Sn content is set as 0.01-10 wt. %, preferably 0.3-3.0 wt. % or more preferably 0.5-2.0 wt. %.

(2) Ni

When Ni is in solid solution within a Cu matrix, it increases the strength, elasticity and solderability, and moreover, forms a compound with P or Si in some cases and precipitates out, thus increasing the electrical conductivity and increasing the strength and elasticity. In addition, it is an element that also contributes to improving the heat resistance and stress relaxation characteristics. However, if the Ni content is less than 0.01 wt. %, then these meritorious effects are not sufficiently obtained but on the other hand if the Ni content exceeds 4.0 wt. %, then the drop in electrical conductivity becomes marked even in the co-presence of P or Si in certain cases and this would be disadvantageous from an economic standpoint. Accordingly, the Ni content is set as 0.014.0 wt. % or preferably 0.5-3.0 wt. %.

(3) P

P acts as a deoxidizer in the melt during melting and casting and also forms a compound with Ni or in some cases Fe or Mg or Co, thus increasing the electrical conductivity and increasing the strength and elasticity. However, if the P content is less than 0.01 wt. %, then these meritorious effects are not sufficiently obtained but on the other hand if the P content exceeds 0.20 wt. %, then the drop in electrical conductivity becomes marked even in the co-presence of Ni or in some cases Fe or Mg or Co, and the solder weatherability (atmospheric resistance of soft solder) deteriorates markedly. This would also have deleterious effects on the hot workability. Accordingly, the P content is set as 0.01-0.20 wt. % or preferably 0.03-0.10 wt. %.

(4) Zn

When in solid solution within a Cu matrix, Zn has the effect of increasing the strength and elasticity and enhancing the melt deoxidizing effect, and also has the effect of reducing the dissolved oxygen elements in the Cu matrix, and also has the effect of increasing the solder weatherability and migration resistance. However, if the Zn content is less than 0.01 wt. %, then these meritorious effects are not sufficiently obtained but on the other hand if the Zn content exceeds 30 wt. %, then not only will the electrical conductivity drop but solderability will drop and also even in combination with other elements, the susceptibility to stress-corrosion cracking becomes heightened, and this is not preferable. Accordingly, the Zn content is set as 0.01-30 wt. %, more preferably 0.01-10 wt. % and even more preferably 0.03-3.0 wt. %.

(5) Si

When co-present with Ni, Si forms a compound and precipitates out into the Cu matrix, and thus has the effect of increasing strength and elasticity without greatly decreasing the electrical conductivity. If the Si content is less than 0.01 wt. %, then these meritorious effects are not sufficiently obtained but on the other hand if the Si content exceeds 1.0 wt. %, then the hot workability drops markedly. Accordingly, the Si content is set as 0.01-1.0 wt. %.

(6) Fe, Co, Mg, Ti, Cr, Zr, Al

When in solid solution within a Cu matrix or when precipitating to form a compound, these elements have the effect of increasing the strength, elasticity and heat resistance, and also increasing the ease of press-blanking. However, if the content is less than 0.01 wt. %, then these meritorious effects are not sufficiently obtained but on the other hand if the content exceeds 3.0 wt. %, then the drop in electrical conductivity will be marked and the heat treatment temperature at the time of manufacture will become high, so this is disadvantageous from an economic standpoint. Accordingly, the content of one or two or more of the aforementioned elements is preferably 0.01-3.0 wt. %.

(7) Oxygen

If oxygen is present in large amounts, then oxides of Si, Fe, Mg, P and the like are formed, and a second phase is preferentially generated at the grain boundaries, so there is a risk of deterioration of the plating reliability and various other properties of the copper-based alloy according to the present invention, so the oxygen content is set to 20 ppm or less.

Next, explanation will be made regarding the reasons why the various processing steps including the heat treatment of the copper-based alloy according to the present invention are limited as above.

The material according to the present invention can be manufactured by the following process. Namely, take an ingot of a copper-based alloy having the indicated elemental composition, and perform cold rolling and annealing until the prescribed sheet thickness is obtained, and then perform a combination of cold rolling at a percent reduction Z that satisfies the above Formula (1) followed by low-temperature annealing performed at a temperature below the recrystallization temperature, to obtain material of the desired sheet thickness.

When homogenization annealing or hot rolling is performed in advance before cold-rolling the ingot, this has the meritorious effect of removing micro or macro segregations of the solute elements that occurred during casting, thus homogenizing the solute element distribution, and in particular, performing hot rolling can make the crystal orientations of the ingot random and make the grains fine and uniform, and moreover this is economically advantageous because the percent rolling reduction can be greatly increased. Accordingly, it is preferable for the ingot to be subjected to at least one of homogenization annealing or hot rolling in advance prior to cold rolling. The homogenization annealing and hot rolling should preferably be performed at 750° C.-900° C. for 30 minutes to 2 hours.

$$Z<100-10X-Y \quad (1)$$

[Here, Z is the percent cold reduction (%), X is the Sn content (wt. %) among the various elements, and Y is the total content (wt. %) of all elements other than Sn and Cu.]

$$0.8(100-10X-Y)<Z<100-10X-Y \quad (2);$$

[Here, Z is the percent cold reduction (%), X is the Sn content (wt. %) among the various elements, and Y is the total content (wt. %) of all elements other than Sn and Cu.]

The percent cold reduction Z (%) is set as given in Formula (1) because performing cold rolling at a percent reduction that satisfies Formula (1) for each of the added elements reduces the {100} planes that may become the starting points of surface wrinkles during bending deformation in the ND plane, and also simultaneously suppresses the degree of concentration of {110} planes, {111} planes and {311} planes, and particularly the {110} planes that cause deterioration of bending workability in the surface-strain tensile stress state, and thus suppresses the deterioration of bending workability. The $S_{ND}$ at this time is such that $S_{ND} \geqq 0.05$. In addition, the limitation as given in Formula (2) is made because, when cold rolling is performed with a percent reduction in a range that satisfies Formula (2), variations in the degrees of concentration of the {100} planes, {110} planes, {111} planes and {311} planes are small and stable. The $S_{ND}$ at this time is such that it satisfies the relation $0.05 \leqq S_{ND} \leqq 0.15$. Moreover, the tensile strength and 0.2% yield strength are improved, while good strength, 0.2% yield strength and bending workability that typically have a tradeoff relationship are both achieved. In addition, when low-temperature annealing is performed below the recrystallization temperature after the final cold rolling, there is virtually no change in the ratio of concentration of the {100} planes, {110} planes, {111} planes and {311} planes, and the tensile strength and 0.2% yield strength are also maintained. Moreover, improved elongation, namely bendability, can be achieved by low-temperature annealing.

Accordingly, it is preferable to perform cold rolling at a percent cold reduction Z (%) that satisfies Formula (1), and even more preferable to perform a combination of cold rolling at a percent cold reduction Z (%) that satisfies Formula (2) and low-temperature annealing at a temperature below the recrystallization temperature. The low-temperature annealing conditions at this time are that annealing be performed preferably at a temperature 50-250° C. below the recrystallization temperature of the copper-based alloy for 30 minutes to 2 hours, for example, at a temperature of 250-350° C. for 30 minutes to 1 hour, but even outside of these conditions, the desired characteristics can be achieved with temperature and time combinations that apply roughly the same amount of heat to the material.

On the other hand, at percent cold reductions that do not satisfy Formula (1), the degree of concentration of {100} planes decreases greatly while the degree of concentration of {110} markedly increases, thus causing great deterioration in the bending workability in the surface stress state. The $S_{ND}$ at this time is such that $S_{ND}<0.05$. If one attempts to increase the bending workability even further, then the tensile strength and 0.2% yield strength deteriorate and the balance between the two is not maintained.

As typical examples of the phenomena described above, consider the relationship between the percent reduction of an alloy of Cu—1.04 wt. % Ni—0.90 wt. % Sn—0.05 wt. % P and the degree of concentration of various crystal orientations in the ND plane, and the relationship between the percent reduction of an alloy of Cu—1.04 wt. % Ni—0.90 wt. % Sn—0.05 wt. % P and the tensile strength, 0.2% yield strength and elongation. At this time, the percent cold reduction Z (%) that satisfies Formula (1) is Z<89.91%. Moreover, the percent cold reduction that satisfies Formula (2) is 71.9%<Z<89.91%. At Z<89.91% and particularly at 71.9% <Z<89.91%, the degree of concentration of {100} planes that become the starting points of surface wrinkles during bending deformation is virtually unchanged. At the same time, the degree of concentration of the {110} planes, which causes marked degradation of the bending workability in the surface-strain tensile stress state, is nearly constant over this region. The $S_{ND}$ at this time is $S_{ND}=0.10$ at a percent reduction of 80%, and $S_{ND}=0.07$ at 85%. In addition, improvements in the tensile strength and 0.2% yield strength are achieved. When the percent reduction exceeds 90%, although the elongation obtained by tensile testing increases, when compared to bend testing, when the width to thickness ratio W/t of the sheet is $W/t\leqq 4$ in the single-axis tensile stress state, the bending workability improves, but at $W/t\geqq 10$ in the surface-strain tensile stress state, the bending workability deteriorates markedly so the results are not comparable to the elongation obtained by tensile testing.

Next, explanation will be made regarding why the various processing steps including the heat treatment of the copper-based alloy according to the present invention are limited as set out above.

The material according to the present invention can be manufactured by the following process. Namely, take an ingot of a copper-based alloy having the indicated elemental composition, and perform a combination process of cold rolling followed by annealing at least one or more times, and then perform intermediate rolling, which is a rolling process before the final cold rolling process, thereby making the x-ray diffraction intensity ratio of the sheet surface $S_{ND}$ such that $0.05\leqq S_{ND}\leqq 0.15$, and thereafter perform annealing to obtain sheet with a grain size of 20 μm or less, and then performing the final cold rolling and low-temperature annealing at a temperature below the recrystallization temperature.

When homogenization annealing or hot rolling is performed in advance before cold-rolling the ingot, this has the meritorious effect of removing micro or macro segregations in the solute elements that occurred during casting, thus homogenizing the solute element distribution, and in particular, performing hot rolling can make the crystal orientations of the ingot random and make the grains fine and uniform, and moreover this is economically advantageous because the percent rolling reduction can be greatly increased. Accordingly, it is preferable for the ingot to be subjected to at least one of homogenization annealing or hot rolling in advance prior to cold rolling. The homogenization annealing and hot rolling should preferably be performed at 750° C.-900° C. for 30 minutes to 2 hours.

When the combination process of cold rolling (preferably cold rolling to 50-90% reduction, and more preferably 55-85% reduction) followed by annealing is performed at least one or more times, and then the intermediate rolling, which is a rolling process before the final cold rolling process, is performed, thereafter the x-ray diffraction intensity ratio of the sheet surface $S_{ND}$ is preferably $0.05\leqq S_{ND}\leqq 0.15$. If $0.05\leqq S_{ND}\leqq 0.15$, then in the annealing performed immediately thereafter the grain distribution becomes uniform if the annealing is performed above the recrystallization temperature. Here, if the temperature and time of the annealing are controlled (preferably to 400-700° C. and 0.5 minutes to 10 hours) so that the grain size becomes 20 μm or less after the annealing, the sheet obtained from the combination of the final cold rolling and annealing below the recrystallization temperature has improved bending workability while maintaining high strength.

Here, when $S_{ND}>0.15$, the temperature and time domains required to obtain the texture described above in the subsequent annealing become narrow and control of the grain size becomes difficult, and moreover, this increases the degree of concentration of {100} planes that become the starting points of indentations during bending deformation in the ND plane, and coarse grains with this orientation have a spotty distribution. On the other hand, when $0.05>S_{ND}$, the orientation plane density of the {110} plane for a representative becomes too high, and because these grains develop to form a group, this leads to localization of surface wrinkles during bending deformation. In addition, if the grain size after the annealing that follows intermediate rolling exceeds 20 μm, then the percent reduction in the final cold rolling required to obtain the required strength becomes excessively large and the bending workability deteriorates.

By the foregoing there is obtained a precipitation-strengthened type copper-based alloy with a superior balance of conductivity, tensile strength, 0.2% yield strength, springiness, Vickers hardness and bending workability. Specifically, the characteristics with superior balance are a conductivity of 25.0% LACS or greater, or preferably 35.0% LACS or greater, a tensile strength of 560 N/mm$^2$ or greater, or preferably 580N/mm$^2$ or greater, a 0.2% yield strength of 550 N/mm$^2$ or greater, or preferably 570 N/mm$^2$ or greater, a spring deflection limit of 400 N/mm$^2$ or greater, or preferably 460 N/mm$^2$ or greater, a Vickers hardness of 180 or preferably 190 or greater, and a bending workability (180° bendability R/t) of 1.0 or less, preferably 0.5 or less or even more preferably 0.

EXAMPLES

The present invention will now be explained with reference to working examples but the technical scope of the present invention is in no way limited thereto.

Examples 1-10 and Comparative Examples 11-15

Copper-based alloys numbered 1-15 with their chemical compositions (wt. %) presented in Table 1 were melted in an Ar atmosphere and cast into 40 40 100 (mm) ingots using a carbon ingot mold. The ingots thus obtained were cut into 40 40 20 (mm) slices and then subjected to homogenization heat treatment at 900° C. for one hour. Thereafter, the slices were hot-rolled from a sheet thickness of 20 mm to 6.0 mm and then water-quenched and pickled after rolling. The details of the conditions for the respective sheets numbered 1-15 thus obtained are presented below.

Invention Example No. 1 was cold-rolled from a thickness of 6.0 mm to 2.5 mm and heat-treated at 550° C. for one hour. Thereafter, it was cold-rolled from a thickness of 2.5 mm to 1.2 mm and heat-treated at 500° C. for one hour. The sheet thus obtained was given a finish cold-rolling from a thickness of 1.2 mm to 0.2 mm and then heat-treated for one hour at 300° C., which is below the recrystallization temperature.

Invention Example No. 2 was cold-rolled from a thickness of 6.0 mm to 2.5 mm and heat-treated at 550° C. for one hour. Thereafter, it was cold-rolled from a thickness of 2.5 mm to 0.8 mm and heat-treated at 500° C. for one hour. The sheet thus obtained was given a finish cold-rolling from a thickness of 0.8 mm to 0.2 mm and then heat-treated for one hour at 300° C., which is below the recrystallization temperature.

Invention Example No. 3 was cold-rolled from a thickness of 6.0 mm to 2.5 mm and heat-treated at 550° C. for one hour. Thereafter, it was cold-rolled from a thickness of 2.5 mm to 1.0 mm and heat-treated at 500° C. for one hour. The sheet thus obtained was given a finish cold-rolling from a thickness of 1.0 mm to 0.2 mm and then heat-treated for one hour at 300° C., which is below the recrystallization temperature.

Invention Example No. 4 was cold-rolled from a thickness of 6.0 mm to 2.5 mm and heat-treated at 550° C. for one hour. Thereafter, it was cold-rolled from a thickness of 2.5 mm to 1.2 mm and heat-treated at 500° C. for one hour. The sheet thus obtained was given a finish cold-rolling from a thickness of 1.2 mm to 0.2 mm and then heat-treated for one hour at 300° C., which is below the recrystallization temperature.

Invention Example No. 5 was cold-rolled from a thickness of 6.0 mm to 2.5 mm and heat-treated at 550° C. for one hour. Thereafter, it was cold-rolled from a thickness of 2.5 mm to 1.0 mm and heat-treated at 500° C. for one hour. The sheet thus obtained was given a finish cold-rolling from a thickness of 1.0 mm to 0.2 mm and then heat-treated for one hour at 300° C., which is below the recrystallization temperature.

Invention Example No. 6 was cold-rolled from a thickness of 6.0 mm to 2.5 mm and heat-treated at 550° C. for one hour. Thereafter, it was cold-rolled from a thickness of 2.5 mm to 1.2 mm and heat-treated at 500° C. for one hour. The sheet thus obtained was given a finish cold-rolling from a thickness of 1.2 mm to 0.2 mm and then heat-treated for one hour at 300° C., which is below the recrystallization temperature.

Invention Example No. 7 was cold-rolled from a thickness of 6.0 mm to 2.5 mm and heat-treated at 550° C. for one hour. Thereafter, it was cold-rolled from a thickness of 2.5 mm to 0.6 mm and heat-treated at 500° C. for one hour. The sheet thus obtained was given a finish cold-rolling from a thickness of 0.6 mm to 0.2 mm and then heat-treated for one hour at 300° C., which is below the recrystallization temperature.

Invention Example No. 8 was cold-rolled from a thickness of 6.0 mm to 2.5 mm and heat-treated at 550° C. for one hour. Thereafter, it was cold-rolled from a thickness of 2.5 mm to 0.6 mm and heat-treated at 500° C. for one hour. The sheet thus obtained was given a finish cold-rolling from a thickness of 0.6 mm to 0.2 mm and then heat-treated for one hour at 300° C., which is below the recrystallization temperature.

Invention Examples No. 9-10 were cold-rolled from a thickness of 6.0 mm to 2.5 mm and heat-treated at 550° C. for one hour. Thereafter, they were cold-rolled from a thickness of 2.5 mm to 0.8 mm and heat-treated at 500° C. for one hour. The sheets thus obtained were given a finish cold-rolling from a thickness of 0.8 mm to 0.2 mm and then heat-treated for one hour at 300° C., which is below the recrystallization temperature.

On the other hand, Comparative Example No. 11 was cold-rolled from a thickness of 6.0 mm to 2.5 mm and heat-treated at 550° C. for one hour. Thereafter, it was cold-rolled from a thickness of 2.5 mm to 0.3 mm and heat-treated at 500° C. for one hour. The sheet thus obtained was given a finish cold-rolling from a thickness of 0.3 mm to 0.2 mm and then heat-treated for one hour at 300° C., which is below the recrystallization temperature.

Comparative Example No. 12 was cold-rolled from a thickness of 6.0 mm to 1.0 mm and heat-treated at 550° C. for one hour. Thereafter, it was cold-rolled from a thickness of 1.0 mm to 0.6 mm and heat-treated at 500° C. for one hour. The sheet thus obtained was given a finish cold-rolling from a thickness of 0.6 mm to 0.2 mm and then heat-treated for one hour at 300° C., which is below the recrystallization temperature.

Comparative Example No. 13 was cold-rolled from a thickness of 6.0 mm to 0.5 mm and heat-treated at 600° C. for one hour. The sheet thus obtained was given a finish cold-rolling from a thickness of 0.5 mm to 0.2 mm and then heat-treated for one hour at 300° C., which is below the recrystallization temperature.

Comparative Example No. 14 was cold-rolled from a thickness of 6.0 mm to 2.5 mm and heat-treated at 550° C. for one hour. The sheet thus obtained was given a finish cold-rolling from a thickness of 2.5 mm to 0.2 mm and then heat-treated for one hour at 250° C., which is below the recrystallization temperature.

Comparative Example No. 15 was cold-rolled from a thickness of 6.0 mm to 2.5 mm and heat-treated at 550° C. for one hour. The sheet thus obtained was given a finish cold-rolling from a thickness of 2.5 mm to 0.2 mm and then heat-treated for one hour at 350° C., which is below the recrystallization temperature.

TABLE 1

| | | Chemical composition (wt. %) | | | | | Process conditions | | | | | | | | |
|---|---|---|---|---|---|---|---|---|---|---|---|---|---|---|---|
| | Examples | Sn | Ni | P | Other | Cu | Thickness after rough cold-rolling (mm) | Rough annealing (conditions) | Thickness after intermediate cold-rolling (mm) | Percent reduction in intermediate cold-rolling (%) | Finish annealing (conditions) | Thickness after finish cold-rolling (mm) | Percent reduction in finish cold-rolling (%) | $Z_{min}$, $Z_{max}$* (%) | Low-temperature anneal (conditions) |
| invention | No. 1 | 0.52 | 1.02 | 0.05 | | Rem | 2.5 | 550° C., 1 h | 1.2 | 52.0 | 500° C., 1 h | 0.2 | 83.3 | 75.0, 93.7 | 300° C., 1 h |
| | No. 2 | 0.90 | 1.04 | 0.05 | | Rem | 2.5 | 550° C., 1 h | 0.8 | 68.0 | 500° C., 1 h | 0.2 | 75.0 | 71.9, 89.9 | 300° C., 1 h |

TABLE 1-continued

| | | Chemical composition (wt. %) | | | | | Process conditions | | | | | | | | |
|---|---|---|---|---|---|---|---|---|---|---|---|---|---|---|---|
| | Examples | Sn | Ni | P | Other | Cu | Thickness after rough cold-rolling (mm) | Rough annealing (conditions) | Thickness after intermediate cold-rolling (mm) | Percent reduction in intermediate cold-rolling (%) | Finish annealing (conditions) | Thickness after finish cold-rolling (mm) | Percent reduction in finish cold-rolling (%) | $Z_{min}$, $Z_{max}$* (%) | Low-temperature anneal (conditions) |
| | No. 3 | 0.90 | 1.04 | 0.05 | | Rem | 2.5 | 550° C., 1 h | 1.0 | 60.0 | 500° C., 1 h | 0.2 | 80.0 | 71.9, 89.9 | 300° C., 1 h |
| | No. 4 | 0.95 | 0.95 | 0.06 | Zn: 0.10 | Rem | 2.5 | 550° C., 1 h | 1.2 | 52.0 | 500° C., 1 h | 0.2 | 83.3 | 71.5, 89.4 | 300° C., 1 h |
| | No. 5 | 1.52 | 0.95 | 0.05 | | Rem | 2.5 | 550° C., 1 h | 1.0 | 60.0 | 500° C., 1 h | 0.2 | 80.0 | 67.3, 84.1 | 300° C., 1 h |
| | No. 6 | 0.95 | 0.60 | 0.05 | | Rem | 2.5 | 550° C., 1 h | 1.2 | 52.0 | 500° C., 1 h | 0.2 | 83.3 | 71.9, 89.9 | 300° C., 1 h |
| | No. 7 | 1.95 | 0.55 | 0.06 | Zn: 0.08 Fe: 0.05 | Rem | 2.5 | 550° C., 1 h | 0.6 | 76.0 | 500° C., 1 h | 0.2 | 66.7 | 63.8, 79.8 | 300° C., 1 h |
| | No. 8 | 1.75 | 0.98 | 0.05 | | Rem | 2.5 | 550° C., 1 h | 0.6 | 76.0 | 500° C., 1 h | 0.2 | 66.7 | 65.2, 81.5 | 300° C., 1 h |
| | No. 9 | 1.74 | 1.55 | 0.07 | | Rem | 2.5 | 550° C., 1 h | 0.8 | 68.0 | 500° C., 1 h | 0.2 | 75.0 | 64.8, 81.0 | 300° C., 1 h |
| | No. 10 | 1.52 | 2.05 | 0.10 | | Rem | 2.5 | 550° C., 1 h | 0.8 | 68.0 | 500° C., 1 h | 0.2 | 75.0 | 66.1, 82.7 | 300° C., 1 h |
| Comparative example | No. 11 | 0.90 | 1.04 | 0.05 | | Rem | 2.5 | 550° C., 1 h | 0.3 | — | 500° C., 1 h | 0.2 | 33.3 | 71.9, 89.9 | 300° C., 1 h |
| | No. 12 | 0.89 | 1.02 | 0.05 | | Rem | 1.0 | 550° C., 1 h | 0.6 | — | 500° C., 1 h | 0.2 | 66.7 | 72.0, 90.0 | 300° C., 1 h |
| | No. 13 | 0.85 | 1.05 | 0.07 | Zn: 0.10 Fe: 0.10 | Rem | 0.5 | 600° C., 1 h | — | — | — | 0.2 | 60.0 | 72.1, 90.2 | 300° C., 1 h |
| | No. 14 | 0.95 | 0.98 | 0.06 | Zn: 0.10 | Rem | 2.5 | 550° C., 1 h | — | — | — | 0.2 | 92.0 | 71.5, 89.4 | 250° C., 1 h |
| | No. 15 | 0.85 | 1.10 | 0.05 | | Rem | 2.5 | 550° C., 1 h | — | — | — | 0.2 | 92.0 | 72.3, 90.4 | 350° C., 1 h |

*Calculation formulae as recited in this patent: $Z_{min} = 0.8\ (100 - 10X - Y)$, $Z_{max} = 100 - 10X - Y$ Examples No. 1-10 obtained as described above had an average grain size of 6-10 μm after the 500° C. 1 hour heat treatment before the final cold rolling, and this was below 20 μm, and when x-ray diffraction of the sheet surface (ND plane) was performed prior to this heat treatment and the $S_{ND}$ was measured, it was found to be 0.06-0.10, or within the range $0.05 \leqq S_{ND} \leqq 0.15$.

Here, the x-ray diffraction intensity measurement conditions are as follows.

X-ray tube: Cu, tube voltage: 40 kV, tube current: 30 mA, sampling interval: 0.0200, monochromator used, specimen holder: Al Note that the x-ray diffraction intensity measurement conditions are not limited to the conditions above, but rather they can be modified appropriately depending on the type of sample.

In addition, the grain size is calculated in the present invention based on the JIS H 0501 standard for grains observed on the sample surface (rolled surface) using an optical microscope at a magnification of 200.

The samples No. 1-15 thus obtained each had dispersed and precipitated Ni—P compounds, but first these samples No. 1-15 were evaluated by measuring the $S_{ND}$. Then their conductivity, tensile strength and 180° bendability were evaluated. The conductivity and tensile strength were evaluated by measurements based on the JIS H 0505 and JIS Z 2241 standards, respectively. In addition, the bendability was evaluated based on a 180° bend test (JIS H 3110), where a 10-mm wide test piece is blanked in a direction parallel to the rolling direction and the bend inside radius R and sheet thickness t are measured to find the ratio R/t, and the test pieces thus obtained are evaluated based on the smallest value of R/t at which no cracks occurred on the surface of the bend. The results are presented in Table 2.

TABLE 2

| | Examples | Chemical composition (wt. %) | | | | | $S_{ND}$ prior to finish anneal (0.05-0.15) | Grain size after finish anneal (μm) (≦20 μm) | $S_{ND}$ of final sheet (0.05-0.15) | Conductivity (% IACS) | Tensile strength (N/mm$^2$) | 180° bendability R/t* (0° direction) |
|---|---|---|---|---|---|---|---|---|---|---|---|---|
| | | Sn | Ni | P | Other | Cu | | | | | | |
| invention | No. 1 | 0.52 | 1.02 | 0.05 | | Rem | 0.10 | 10 | 0.09 | 48.2 | 580 | 0.5 |
| | No. 2 | 0.90 | 1.04 | 0.05 | | Rem | 0.10 | 8 | 0.11 | 40.5 | 595 | 0 |
| | No. 3 | 0.90 | 1.04 | 0.05 | | Rem | 0.10 | 8 | 0.09 | 40.2 | 600 | 0 |
| | No. 4 | 0.95 | 0.95 | 0.06 | Zn: 0.10 | Rem | 0.10 | 8 | 0.07 | 39.3 | 615 | 0.5 |

TABLE 2-continued

| Examples | | Chemical composition (wt. %) Sn | Ni | P | Other | Cu | $S_{ND}$ prior to finish anneal (0.05-0.15) | Grain size after finish anneal (μm) (≦20 μm) | $S_{ND}$ of final sheet (0.05-0.15) | Conductivity (% IACS) | Tensile strength ($N/mm^2$) | 180° bendability R/t* (0° direction) |
|---|---|---|---|---|---|---|---|---|---|---|---|---|
| | No. 5 | 1.52 | 0.95 | 0.05 | | Rem | 0.10 | 8 | 0.07 | 35.4 | 635 | 0.5 |
| | No. 6 | 0.95 | 0.60 | 0.05 | | Rem | 0.08 | 10 | 0.11 | 43.5 | 600 | 0 |
| | No. 7 | 1.95 | 0.55 | 0.06 | Zn: 0.08 Fe: 0.05 | Rem | 0.06 | 6 | 0.10 | 33.8 | 625 | 0.5 |
| | No. 8 | 1.75 | 0.98 | 0.05 | | Rem | 0.07 | 7 | 0.09 | 33.5 | 610 | 0.5 |
| | No. 9 | 1.74 | 1.55 | 0.07 | | Rem | 0.07 | 10 | 0.06 | 29.8 | 645 | 1.0 |
| | No. 10 | 1.52 | 2.05 | 0.10 | | Rem | 0.07 | 8 | 0.07 | 28.5 | 635 | 1.0 |
| Comparative Example | No. 11 | 0.90 | 1.04 | 0.05 | | Rem | 0.07 | 8 | 0.16 | 40.5 | 490 | 0.5 |
| | No. 12 | 0.89 | 1.02 | 0.05 | | Rem | 0.16 | 25 | 0.17 | 41.5 | 540 | 2 |
| | No. 13 | 0.85 | 1.05 | 0.07 | Zn: 0.10 Fe: 0.10 | Rem | 0.03 | 25 | 0.18 | 41.5 | 540 | 2 |
| | No. 14 | 0.95 | 0.98 | 0.06 | Zn: 0.10 | Rem | 0.14 | 10 | 0.04 | 40.2 | 645 | 2.5 |
| | No. 15 | 0.85 | 1.10 | 0.05 | | Rem | 0.15 | 10 | 0.03 | 41.0 | 565 | 1.5 |

*The minimum R/t at which no cracks occur when the thickness of the test piece is t mm, the width is W mm (W/t = 50) and the bend inside radius is R mm.

The following is clear from the results of Table 1 and Table 2.

Alloys No. 1-10 according to the present invention have an $S_{ND}$ prior to the finish annealing of 0.06-0.10, so this satisfies the condition $0.05 \leqq S_{ND} \leqq 0.15$, and the grain size after the subsequent annealing is 6-10 μm, so this satisfies the condition of being less than 20 μm, and the final sheet also has an $S_{ND}$ of 0.06-0.11, so this satisfies the condition $0.05 \leqq S_{ND} \leqq 0.15$, and they had superior bending workability and had a superior balance of conductivity and tensile strength.

On the other hand, Comparative Example No. 11 had a finish rolling percent reduction after the finish annealing that did not satisfy the lower limit of Formula (2), and while its bending workability was satisfactory, its tensile strength was 490 $N/mm^2$ which was inferior to the tensile strength of Examples No. 1-10 according to the present invention.

Comparative Examples No. 12 and 13 have a grain size after final annealing in excess of 20 μm, and their tensile strength was low at 540 $N/mm^2$ and their bending workability was also inferior.

Comparative Examples No. 14 and 15 have a finish rolling percent reduction after the finish annealing that did not satisfy the upper limit of Formula (2), and while No. 14 exhibited a high value of 645 $N/mm^2$ for its tensile strength, its bending workability is inferior. No. 15 was aiming for improved bending workability by increasing the low-temperature annealing temperature by 100° C. over that of No. 14, but the bending workability was not improved as much as one would think and the tensile strength dropped to 565 $N/mm^2$.

Example 2

Alloy No. 3 according to the present invention presented in Table 1 of Example 1 (with a sheet thickness of 0.20 mm) and a commercial phosphor bronze alloy (C5191, grade H, sheet thickness 0.20 mm: 6.5 wt. % Sn, 0.2 wt. % P, remainder Cu) were subjected to an evaluation of their conductivity, tensile strength, 0.2% yield strength, springiness, Vickers hardness and bending workability.

The measurement of the conductivity, tensile strength, 0.2% yield strength, spring reflection limit and Vickers hardness were performed according to the JIS H 0505, JIS Z 2241, JIS H 3130 and JIS Z 2241 standards, respectively. The bending workability was evaluated based on a 180° bend test (JIS H 3110), where a 10-mm wide test piece is blanked in a direction parallel to the rolling direction and the bend inside radius R and sheet thickness t are measured to find the ratio R/t, and the test pieces thus obtained are evaluated based on the smallest value of R/t at which no cracks occurred on the surface of the bend. The results are presented in Table 3.

TABLE 3

| | Conductivity (% IACS) | Tensile strength ($N/mm^2$) 0°, 90° directions | 0.2% yield strength ($N/mm^2$) 0°, 90° directions | Spring reflection limit ($N/mm^2$) 0°, 90° directions | Vickers hardness ($H_V$) | Minimum R/t* 0°, 90° directions | $S_{ND}$ of the final sheet (0.05-0.15) |
|---|---|---|---|---|---|---|---|
| Alloy No. 3 of the present invention | 40 | 600, 630 | 590, 600 | 460, 560 | 190 | 0, 2.0 | 0.09 |
| C5191 H | 13 | 638, 642 | 634, 575 | 390, 540 | 195 | 0.5, 2.0 | 0.03 |

*The minimum R/t at which no cracks occur in the bend surface when subjected to 90° double bending.

From the results of Table 3, one can see that in comparison to the conventional copper-based alloy C5191 H typically used for connectors, switches and relays, the copper-based alloy according to the present invention had a markedly higher conductivity and superior balance of tensile strength, 0.2% yield strength, spring bending elastic limit, Vickers hardness and bending workability.

The copper-based alloy according to the present invention can be used in narrow-pitch connectors for use in telecommunications, automotive harness connectors, semiconductor lead frames and compact switches and relays and the like.

What is claimed is:

1. A method of manufacturing a sheet of a copper-based alloy, containing Ni: 0.01-4.0 wt. %, Sn: 0.01-10 wt. %, and P: 0.01-20 wt. %, optional containing 0.03-3.0 wt. % of Zn or 0.01-3.0 wt. % of at least one element selected from the group consisting of Fe, Co, Mg, Ti, Cr, Zr, and Al with the remainder being Cu and unavoidable impurities, where the x-ray diffraction intensity ratio of the surface $S_{ND}$ is such that $0.05 \leqq S_{ND} \leqq 0.15$, provided that $S_{ND}=I\{200\} \div [I\{111\}+I\{220\}+I\{311\}]$, where I{200} is the x-ray diffraction intensity of the {100} plane, I{111} is the x-ray diffraction intensity of the {111} plane, I{220} is the x-ray diffraction intensity of the {110} plane, and I{311} is the x-ray diffraction intensity of the {311} plane, comprising the steps of:

taking an ingot of a copper-based alloy having the indicated elemental composition, performing a combination process of cold rolling followed by annealing at least one time, thereafter performing intermediate cold rolling, which is a cold rolling process before a final cold rolling process, thereby making the x-ray diffraction intensity ratio of the sheet surface $S_{ND}$ such that $0.05 \leqq S_{ND} \leqq 0.15$, performing annealing with controlling a temperature and time to obtain sheet with a grain size of 20 μm or less, and performing the final cold rolling at a percent reduction Z that satisfies the following Formula:

$$0.8 \times (100-10X-Y) < Z < 100-10X-Y$$

where Z is the percent cold reduction (%), X is the Sn content (wt. %) among the various elements, and Y is the total content (wt. %) of all elements other than Sn and Cu, followed by low-temperature annealing performed at a temperature below the recrystallization temperature.

2. The method according to claim 1 wherein, prior to performing the combination process, at least one process selected in advance from among homogenization annealing and hot rolling is performed on the ingot.

3. The method according to claim 2, wherein the homogenization annealing and hot rolling are performed at a temperature of 750-900° C.

4. The method according to claim 1, wherein the oxygen content of the copper-based alloy is 200 ppm or less.

5. The method according to claim 1, wherein the sheet of copper-based alloy has a 180° bendability showing R/t of 1.0 or less, where R/t is a value at which no cracks occur when the width W to thickness ratio W/t of the sheet is 10 or greater and the bend inside radius is R mm.

6. The method according to claim 1, wherein the annealing between intermediate cold rolling and final cold rolling is performed at a temperature of 400-700° C.

* * * * *